US009482237B1

(12) United States Patent
Pesteil et al.

(10) Patent No.: US 9,482,237 B1
(45) Date of Patent: Nov. 1, 2016

(54) METHOD OF DESIGNING A MULTI-STAGE TURBOMACHINE COMPRESSOR

(71) Applicant: SNECMA, Paris (FR)

(72) Inventors: Agnes Claire Marie Pesteil, Alfortville (FR); Vincent Paul Gabriel Perrot, Maisons Alfort (FR)

(73) Assignee: SNECMA, Paris (FR)

( * ) Notice: Subject to any disclaimer, the term of this patent is extended or adjusted under 35 U.S.C. 154(b) by 888 days.

(21) Appl. No.: 13/850,755

(22) Filed: Mar. 26, 2013

(51) Int. Cl.
*F04D 29/44* (2006.01)
*F04D 29/00* (2006.01)

(52) U.S. Cl.
CPC ..... *F04D 29/00* (2013.01)

(58) Field of Classification Search
CPC ..... F01D 5/141; F01D 5/142; F01D 5/143; F01D 5/147; F05D 2250/184
USPC ..... 415/199.5
See application file for complete search history.

(56) References Cited

U.S. PATENT DOCUMENTS

2011/0286856 A1* 11/2011 Micheli ..... F01D 5/141 416/241 R

OTHER PUBLICATIONS

U.S. Appl. No. 13/935,827, filed Jul. 5, 2013, Perrot, et al.

* cited by examiner

*Primary Examiner* — Jason Shanske
(74) *Attorney, Agent, or Firm* — Oblon, McClelland, Maier & Neustadt, L.L.P

(57) ABSTRACT

A method for designing a multi stage compressor of a turbomachine includes: determining the appropriate number of blades of each rotor blading; determining by instationary computations the trajectories of the slipstreams of the trailing edges of the blades of a rotor blading of an upstream stage n to the leading edges of the blades of a rotor blading of a downstream stage n+1; positioning angularly this rotor blading of the downstream stage n+1 so that the slipstreams pass substantially in the middle of the inter blade circumferential spaces of this blading; repeating these operations for all the stages in order to achieve an aerodynamic coupling on all of the rotor bladings of the compressor; and validating the respective positions of the rotor bladings by new instationary computations on the whole of the compressor.

9 Claims, 4 Drawing Sheets

METHOD OF DESIGNING A MULTI-STAGE TURBOMACHINE COMPRESSOR

TECHNICAL FIELD

The present invention relates to a method for designing a multi-stage compressor of a turbomachine such as an aircraft turbojet or turboprop.

PRIOR ART

A turbomachine compressor comprises a plurality of stages which are each formed of a moveable rotor blading or grid and of a fixed stator blading or grid. Each blading is formed of an annular array of blades evenly distributed about the longitudinal axis of the compressor.

A turbomachine turbine also consists of several stages of the aforementioned type. In order to improve the performance of a turbine, it is known practice to produce a multi-stage aerodynamic coupling called "clocking" between two consecutive rotor bladings separated from one another by a stator blading, or between two consecutive stator bladings separated from one another by a rotor blading.

In the current technology, the multi-stage aerodynamic coupling of a turbine consists in selecting two consecutive bladings of the same type (that is to say two rotor bladings or two stator bladings), and in positioning angularly the downstream blading relative to the upstream blading so that the slipstreams or wakes formed at the trailing edges of the blades of the upstream blading impact with a certain tolerance the leading edges of the blades of the downstream blading.

Application EP-A1-2 071 127 describes a method for designing a multi-stage turbine of a turbomachine.

Multi-stage aerodynamic coupling is widely used in a turbine of a turbomachine but is not used effectively in a compressor of a turbomachine. A method of aerodynamic coupling suitable for a turbine cannot be used for a compressor, in particular because the interactions between the bladings of a compressor are potentially greater than those between the bladings of a turbine. Specifically, the increasing evolution of the static pressure from upstream to downstream in a compressor (it is the inverse in a turbine) tends to promote detachments on the blade profiles, all the more so if the compressor is loaded. These detachments generate slipstreams that are generally more energetic and thick in compressors.

Moreover, the aerodynamic coupling methods of the prior art are not entirely satisfactory because the trajectories of the flows through a stage are determined by stationary computations (with mixing planes between two bladings, that is to say that the aerodynamic magnitudes are azimuthally averaged) which are not sufficiently precise because they do not take account of all of the stages and of the influence of the other stages on the stage in question.

A notable object of the invention is to provide a simple, effective and economical solution to these problems.

BRIEF DESCRIPTION OF THE INVENTION

The invention proposes a method for designing a multi-stage compressor of a turbomachine, each compressor stage comprising a rotor blading and a stator blading each formed of an annular array of blades, characterised in that it comprises the steps consisting in:

a) determining the number of blades of each rotor (or stator, respectively) blading, b) determining by instationary computations the trajectories of the slipstreams of the trailing edges of the blades of a rotor (or stator, respectively) blading of an upstream stage n to the leading edges of the rotor blades of a downstream stage n+1, positioning angularly this rotor blading of the downstream stage n+1 so that the slipstreams pass substantially between the leading edges of the blades of this rotor blading, substantially in the middle of the inter-blade circumferential spaces, and repeating these operations for all the stages, from upstream to downstream, in order to achieve an aerodynamic coupling on all of the rotor (or stator, respectively) bladings of the compressor, c) validating the respective positions of the rotor (or stator, respectively) bladings by new instationary computations on the whole of the compressor.

The inventors have found that, in a turbomachine compressor, a better performance of the compressor is obtained when the slipstreams of the trailing edges of the blades of an upstream blading pass between the leading edges of the blades of a downstream blading of the same type, that is to say that they do not impact these leading edges. These slipstreams are designed to pass substantially in the middle of the inter-blade circumferential spaces of the downstream blading with a certain angular tolerance, for example of the order of 10% of the inter-blade pitch. The improvement in performance of the compressor makes it possible to reduce the fuel consumption of the turbomachine.

According to the invention, instationary computations, such as Navier-Stokes 3D or similar instationary computations (of the harmonic non-linear type), are used to determine the trajectories of the slipstreams. These computations make it possible to compute, without discontinuity, the trajectory of the slipstreams of a first blading to the outlet of the compressor, and therefore to take account of the influence of all of the relative positions of the bladings of all the stages on the trajectories of these slipstreams.

In the present application, "instationary computations" means computations which determine the trajectories of the flows in the whole compressor, that is to say through all the stages of the compressor, by virtue of the computation of all the aerodynamic magnitudes along the compressor, without ever being averaged. Conversely, stationary computations are computations which evaluate, between two bladings, the trajectories of the flows in a transverse mixing plane in which various parameters (P, T, etc.) are averaged.

The step a) consists preferably in determining an adequate number of blades to optimise the method and in particular to maximise the aerodynamic interactions between the bladings.

The step b) may be carried out for a given operating point and at at least one given stream height. It is however possible to envisage producing the aerodynamic coupling on several different stream heights, the number of these heights having to be defined, notably as a function of the computing power available. The chosen operating point may be that for which the compression efficiency is greatest.

The angular position of the rotor (or stator) blading of the downstream stage n+1 is preferably determined by computation by tracing a sinusoidal curve representing the evolution of the efficiency of the compressor as a function of the angular position of this blading, and by selecting the position for which the curve reaches a maximum.

This sinusoidal curve may be traced by means of three-point coordinates, that is to say by means of efficiency values computed for three different, uniformly distributed, positions of the rotor (or stator) blading of the downstream stage n+1.

The step b) may be preceded by a step consisting in determining the geometries of the blades of each rotor (or stator, respectively) blading then in evaluating the aerodynamic performance of the compressor by stationary computations.

The method may also comprise a step consisting in modifying the geometries of the blades of each rotor (or stator, respectively) blading, and then in re-evaluating the aerodynamic performance of the compressor by stationary computations. The aerodynamic coupling can then be updated after the re-evaluation of the performance of the compressor, by repeating the step b). As a variant, the aerodynamic coupling is updated in a simplified manner, by determining the geometric modifications applied to the blades of a rotor (or stator, respectively) blading of an upstream stage n, by determining by geometric computation the influence of these modifications on the trajectories of the slipstreams of the trailing edges of the blades of this blading, by adapting accordingly the angular position of the rotor blading of the downstream stage n+1, and by repeating these operations for all the stages, from upstream to downstream.

The present invention also relates to a turbomachine, such as an aircraft turbojet or turboprop, characterised in that it comprises a compressor designed by means of the method as described above.

DESCRIPTION OF THE FIGURES

The invention will be better understood and other details, features and advantages of the invention will become evident on reading the following description made as a non-limiting example with reference to the appended drawings in which.

DETAILED DESCRIPTION

Figure 1:
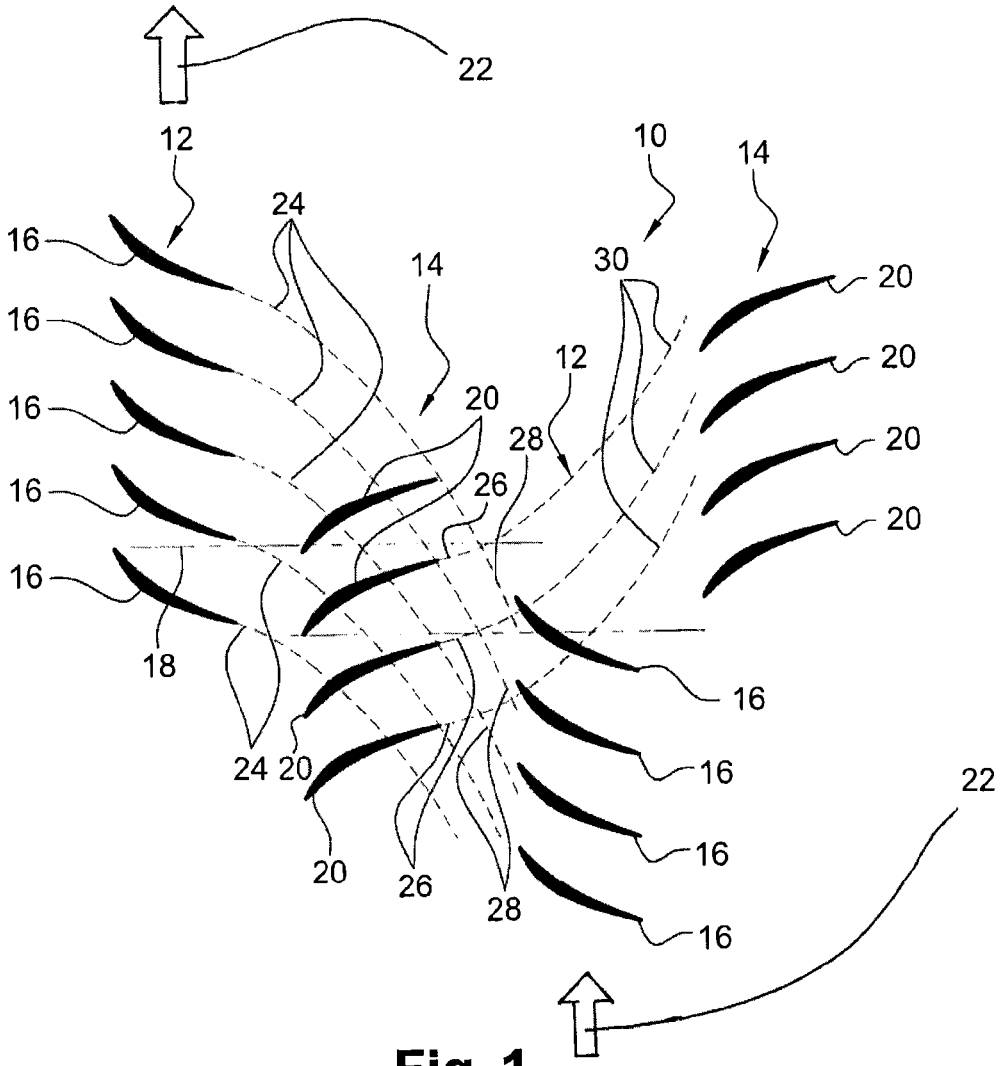
FIG. 1 a very schematic, partial view of a multi-stage compressor of a turbomachine, seen from above.

Reference is made first to FIG. 1 which represents partially and in a very schematic manner a multi-stage compressor 10 of a turbomachine such as an aircraft turbojet or turboprop, this compressor 10 comprising a finite number k of stages each comprising a rotor blading or grid 12, and a stator blading or grid 14 situated downstream of the rotor blading 12.

Each rotor blading 12 comprises a plurality of blades 16 which are evenly distributed about the longitudinal axis 18 of the compressor. Each stator blading 14 comprises a plurality of blades 20 which are also evenly distributed about the axis 18 of the compressor and which are supported by an outer casing, not shown, of the compressor. In the example shown, the stator bladings 14 and rotor bladings 12 that are shown each comprise four or five blades for reasons of clarity.

The rotor bladings 12 are rotated in the same direction (schematically represented by the arrows 22) about the axis 18. The stator bladings are fixed and their blades are designed to straighten out the flow of the gases in the compressor. The blades 16, 20 comprise, in a known manner, an upstream leading edge and a downstream trailing edge of the gases flowing in the stream of the compressor.

In the current technology, it is known practice to position angularly the stator bladings 14 of a turbine relative to one another so that the slipstreams of the blades 20 of an upstream stator blading impact the leading edges of the blades 20 of the stator blading situated directly downstream, that is to say separated from the upstream stator blading by a single rotor blading.

Conversely, in the method according to the invention, the stator bladings 14 of the compressor are positioned angularly relative to one another so that the slipstreams of the blades 20 of an upstream stator blading pass between the leading edges of the blades 20 of the stator blading situated directly downstream, substantially in the middle of the inter-blade spaces.

In the example of FIG. 1, the dashed lines 24 and 26 represent respectively the slipstreams of the trailing edges of the blades 16 of the rotor blading 12 and of the trailing edges of the blades 20 of the stator blading 14 of a stage n, and the dashed lines 28 and 30 represent respectively these slipstreams that have passed through the blading of different type of the stage n and which pass between the leading edges of the rotor blades 16 and between the leading edges of the stator blades 20 of the stage n+1.

Figure 2:
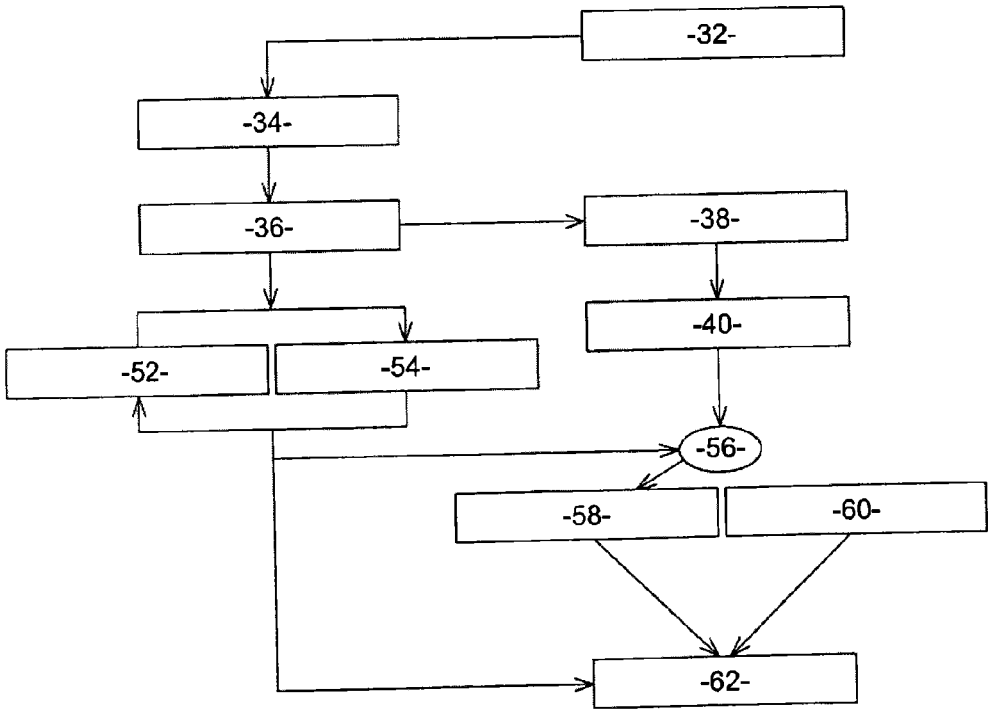
FIG. 2 is a flowchart illustrating the various steps of one embodiment of the method according to the invention.

FIG. 2 is a flowchart representing a non-limiting embodiment of the method according to the invention.

In the following description, the method will be described as being applied to the stator bladings of a compressor of a turbomachine. The method according to the invention is however applicable in the same manner to the rotor bladings of this compressor.

The method comprises a first step 32 consisting in determining the number of blades of each stator blading so as to optimise the aerodynamic coupling and the performance of the compressor. The number of blades of each blading is determined in order to maximise the relative interactions between the bladings, that is to say the slipstream effects of an upstream blading on a downstream blading and optionally the potential effects of a downstream blading on an upstream blading.

Ideally, the stator bladings all have the same number of blades, which makes it possible to simplify the aerodynamic coupling because all the blades of a downstream blading can be positioned optimally relative to the slipstreams of the upstream stage, that is to say so that these slipstreams all pass between the blades of the downstream stage.

However, it is possible to envisage that a downstream blading has a number of blades that is a multiple (of order 2 or 3 for example) of the number of blades of an upstream blading. This is for example the case when a compromise with other design criteria must be adopted, notably to take account of the distribution of the loads between stages. If a downstream blading comprises twice as many blades as an upstream blading, a compromise is adopted so that the blades of the downstream blading are each positioned between the aforementioned optimal position and a critical position (slipstreams of the upstream blading impacting the leading edges of the blades of the downstream blading).

The method may comprise a step 34 consisting in determining the geometries of the blades of each stator blading, then a step 36 of evaluating the performance of the compressor by stationary Navier-Stokes 3D computations with mixing planes. These computations do not take full account of the aerodynamic coupling between the stages. In transverse planes called mixing planes, situated approximately half way axially between the trailing edges of the stator blades and the leading edges of the rotor blades, the average values of all the aerodynamic magnitudes are determined (such as the pressure, the temperature, etc.). The performance of the compressor can be calculated on the basis of the averaged magnitudes without modelling the instationary interactions (hence depending on time) between the bladings.

The method according to the invention may comprise a step 38 consisting in choosing an operating point and a stream height for which the aerodynamic coupling will be achieved. The operating point corresponds to the engine speed and to the aerodynamic operating point on a given speed and the stream height corresponds to a radial position relative to the blades of the stator bladings. If the aerodynamic coupling is achieved half way up the stream, this coupling is achieved on a circumference passing substantially half way up the blades of the stator bladings.

The method comprises another step 40 consisting in determining, by Navier-Stokes 3D or similar instationary computations, the trajectories of the slipstreams of the trailing edges of the blades of an upstream stator blading n, in positioning angularly a downstream stator blading n+1 so that these slipstreams pass substantially between the leading edges of the blades of this downstream blading, substantially in the middle of the inter-blade circumferential spaces, and in repeating these operations for all the stator bladings from upstream to downstream of the compressor.

Figure 3:
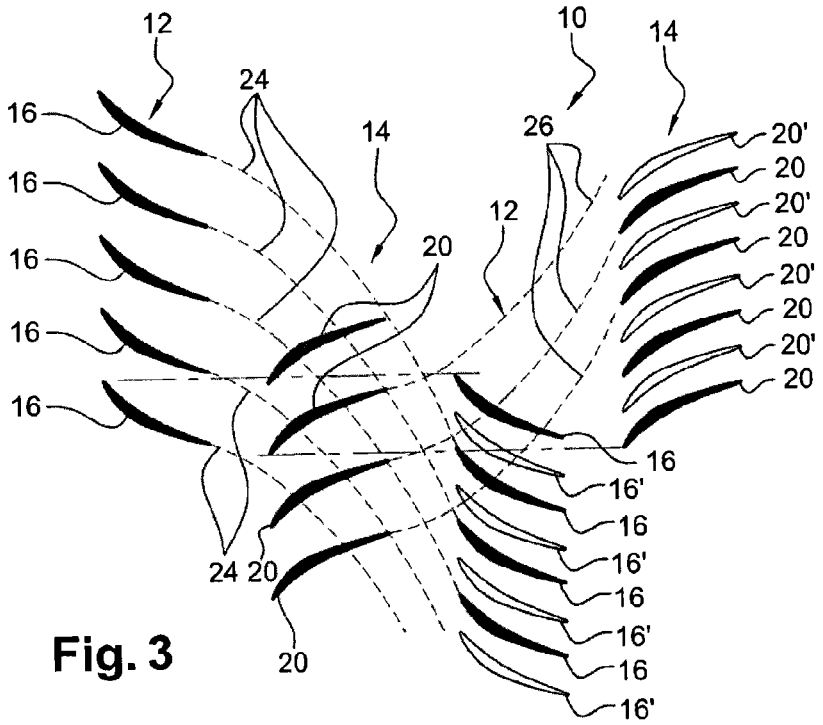
FIG. 3 is another partial, very schematic view of a multi-stage compressor of a turbomachine, seen from above.

FIG. 3 illustrates this step 18 of the method very schematically. The reference numbers used in this figure are the same as those of FIG. 1 when they indicate the same elements.

It is found that the blades 20' of the downstream stator blading 14 are positioned optimally relative to the slipstreams of the trailing edges of the blades 20 of the upstream stator blading 14, these slipstreams passing between the blades 20', and that the blades 20 of the downstream stator blading 14 are positioned critically relative to the slipstreams of the trailing edges of the blades 20 of the upstream stator blading 14, these slipstreams impacting the leading edges of these blades 20. In the same manner, the blades 16' of the downstream rotor blading 12 are positioned optimally relative to the slipstreams of the blades 16 of the upstream rotor blading 12 and the blades 16 of the downstream rotor blading 12 are positioned critically relative to the slipstreams of the blades 16 of the upstream rotor blading 12.

Figure 5:
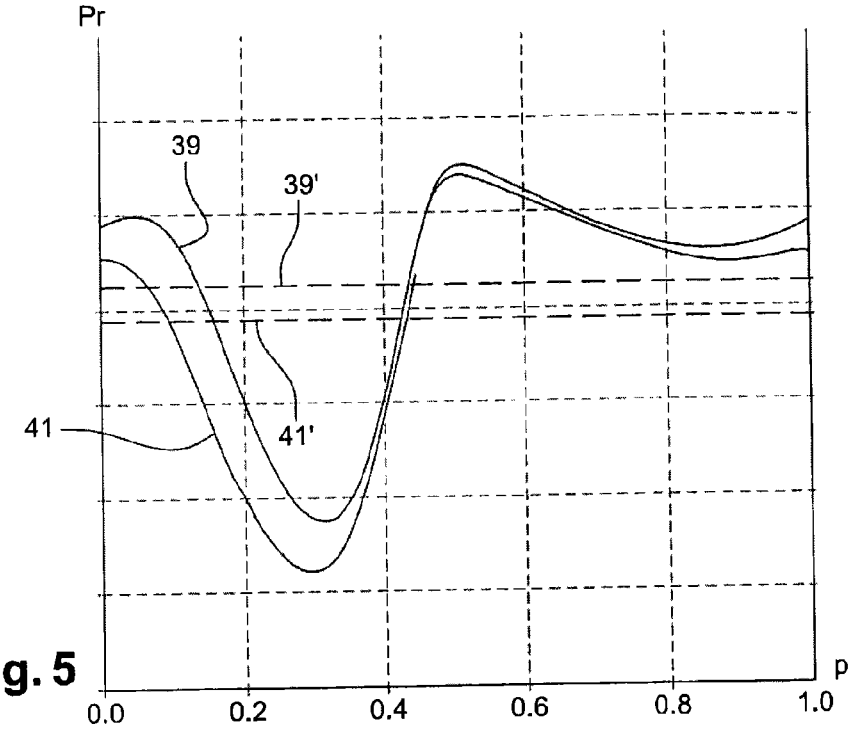
FIG. 5 is a graph representing the evolution of the absolute total pressure in the stream of the compressor on an inter-blade pitch.

FIG. 5 is a graph representing the evolution of the absolute total pressure downstream of a stator blading on an inter-blade pitch, and half way up the stream. The curve 39 represents this evolution when the stator blading is in the aforementioned optimal position and the curve 41 represents this evolution when the stator blading is in the aforementioned critical position. The line 39' represents the value of the average total pressure for the optimal position and the line 41' represents that for the critical position. Comparing the shapes of the curves 39 makes it possible to conclude on the fact that the slipstream downstream of the stator blading is narrower and less deep when it is in optimal position, and comparing the lines 39', 41' makes it possible to affirm that the value of total pressure is higher if the stator blading is in optimal position, which is one of the objects sought during the aerodynamic coupling in a compressor.

Figure 6:
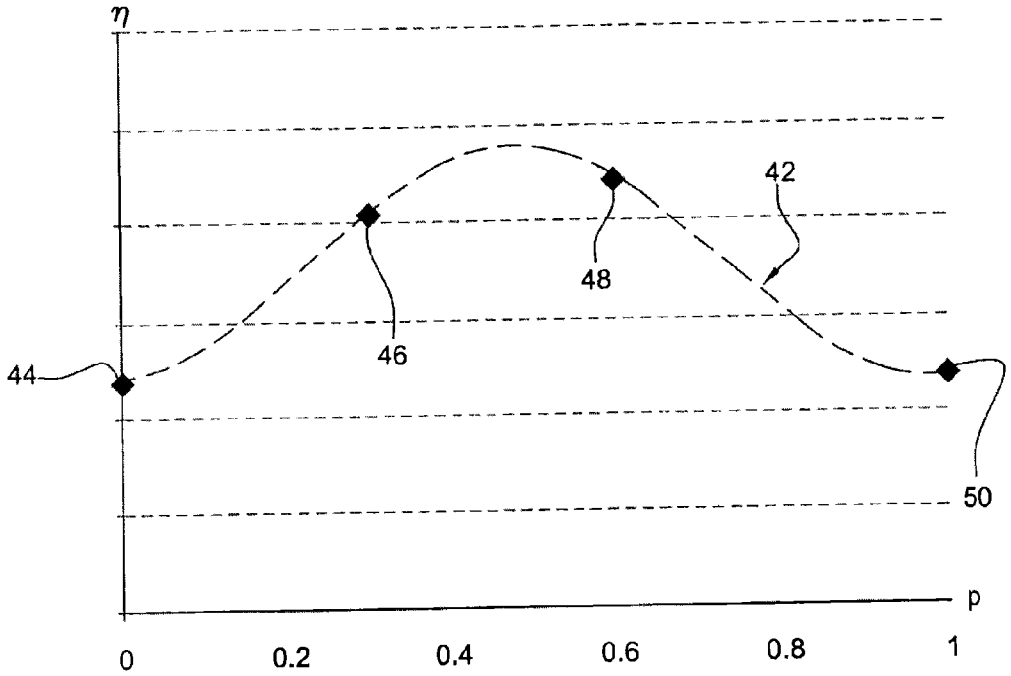
FIG. 6 is a graph representing the evolution of the efficiency of the compressor as a function of the angular position of a blading.

In practice, the angular position of a downstream stator blading n+1 relative to an upstream stator blading n can be determined by means of a graph representing the evolution of the efficiency (η) of the compressor as a function of the angular position (p) of the downstream blading n+1. Such a graph is shown in FIG. 6. The angular position (p) is expressed as a percentage of the inter-blade pitch, the value 0.5 or 50% corresponding to a half inter-blade pitch.

The curve 42 of evolution of the efficiency (η) of the compressor as a function of the angular position (p) of the downstream blading has a sinusoidal shape and can be traced by means of coordinates of three points 44, 46, 48 only, the coordinates of the fourth point 50 of the curve, that is visible in FIG. 6, being deduced from those of the first point because, due to the cyclic repetitiveness, the efficiency value of the compressor at the angular position 1 or 100% of the inter-blade pitch is equal to that at the angular position 0 or 0% of the inter-blade pitch.

The results of the example illustrated in FIG. 6 make it possible to conclude that the downstream stator blading must be offset angularly by a half inter-blade pitch relative to the initial position 0 for it to have an optimal position as described above.

The method may also comprise, in parallel with the step 40, steps 52 and 54 consisting respectively in modifying the geometries of the blades of the stator bladings in order to improve the performance of the compressor, and in re-evaluating these performances by stationary Navier-Stokes 3D computations with mixing planes. These steps 52, 54 may be repeated one or more times.

The steps 34, 36, 52 and 54 are usually used for designing in a conventional manner, that is to say without taking account of a multi-stage aerodynamic coupling, the stator bladings of a compressor.

The results 56 of this conventional design may be used in the method according to the invention in two distinct ways depending on whether the modifications of the blade geometries made in the step 52 are considerable or on the other hand are relatively minor.

If the optimised geometries of the blades are very different from those that have been used during the step 38, this step 38 is repeated again.

Conversely, a simplified and hence quicker methodology 58 can be used to update the aerodynamic coupling in the compressor. This simplified methodology consists in optimising the aerodynamic coupling of a given configuration (with the optimised geometries of the blades) on the basis of another configuration that is close (with the initial geometries of the blades) and already optimised in terms of clocking, the differences between the geometries being limited to a few differences of geometric parameters between a few bladings.

The simplified methodology therefore consists in determining, on the basis of the differences in geometry between two configurations, offsets to be made on the positions of the stator bladings in order to move from an optimised aerodynamic coupling for the initial configuration to an optimised aerodynamic coupling for the new configuration.

The geometric parameters that may be taken into account are for example the angle formed between the trailing edge of each blade of a stator blading and a plane passing through the longitudinal axis of the compressor, the axial position of the leading edge or trailing edge of a stator blading (associated with a modification of chord for example), the tangential stacking of upstream and downstream stator bladings, etc.

Figure 4:
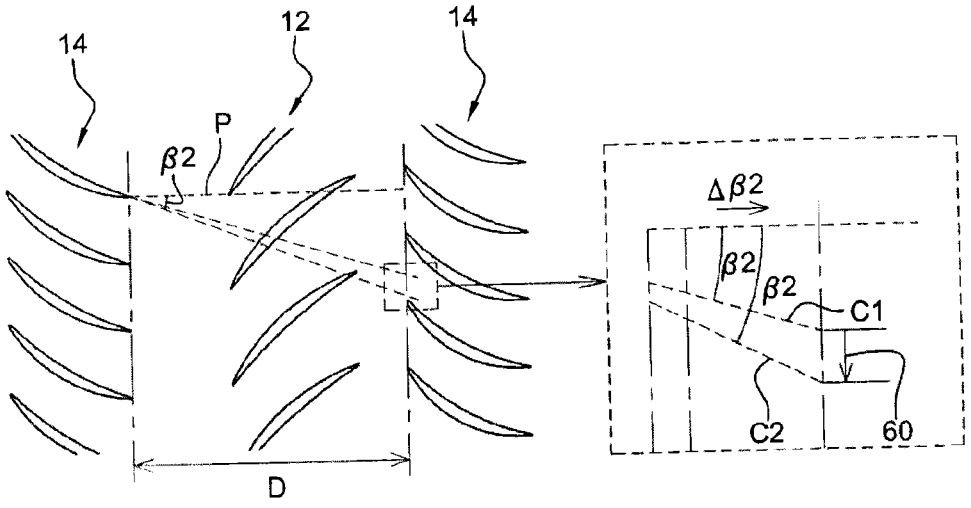
FIG. 4 is a view on a larger scale of a portion of FIG. 3 and illustrates a step of the method according to the invention.

FIG. 4 illustrates an exemplary embodiment of the step 58. In this example, the modification of the angle β2 of the upstream stator blading (that is to say the angle formed between the trailing edge of each blade of this blading and a plane P passing through the longitudinal axis of the compressor) involves an azimuthal or circumferential offset of the downstream stator blading according to the following formula:

$$\text{offset (mm)}=[\tan(\beta 2 \text{ upstream blading configuration } C1)-(\tan \beta 2 \text{ upstream blading configuration } C2)]\times D,$$

D being the distance between the trailing edges of the blades of the upstream blading and the leading edges of the blades of the downstream blading.

The angle β2 of the upstream stator blading increases in absolute value from the initial configuration C1 to the new configuration C2. This involves an offset of the downstream stator blading in the direction of rotation of the stator (arrow 60).

A final step 62 of the method according to the invention consists in validating the respective positions of the stator bladings by new Navier-Stokes 3D or similar instationary computations on the whole of the compressor.

The invention claimed is:

1. A method for modifying a multi stage compressor of a turbomachine, the method comprising:

providing the multi stage compressor, each compressor stage comprising a rotor blading and a stator blading each formed of an annular array of blades;

determining a number of blades of at least one of each rotor blading and each stator blading for each stage of the compressor;

creating a computer model of at least one of each rotor blading and each stator blading of the compressor;

determining by instationary computations trajectories of slipstreams of trailing edges of the blades of at least one of a rotor blading and a stator blading of an upstream stage n to leading edges of blades of at least one of a rotor blading and a stator blading of a downstream stage n+1 in the computer model;

positioning angularly the at least one of the rotor blading and the stator blading of the downstream stage n+1 in the computer model so that the slipstreams pass between the leading edges of the blades of the at least one of the rotor blading and the stator blading of the downstream stage n+1, substantially in a middle of inter blade circumferential spaces;

repeating the determining by instationary computations and the positioning for all the stages of the computer model, from upstream to downstream, in order to achieve an aerodynamic coupling on all of at least one of the rotor bladings and stator bladings of the compressor;

validating the respective positions of at least one of the rotor bladings and the stator bladings by new instationary computations on the entire compressor; and modifying the positions of at least one of the rotor bladings and the stator bladings based on the positioning.

2. The method according to claim 1, wherein the determining by instationary computations is carried out for a given operating point and at at least one given stream height.

3. The method according to claim 1, wherein the angular position of the at least one of the rotor blading and the stator blading of the downstream stage n+1 is determined by computation by tracing a sinusoidal curve representing an evolution of efficiency of the compressor as a function of the angular position of the at least one of the rotor blading and the stator blading, and by selecting the position for which the sinusoidal curve reaches a maximum.

4. The method according to claim 3, wherein the sinusoidal curve is traced by efficiency values computed for three different positions of the at least one of the rotor blading and the stator blading of the downstream stage n+1.

5. The method according to claim 1, wherein the determining by instationary computations is preceded by determining geometries of the blades of each of the at least one of the rotor blading and the stator blading, and evaluating aerodynamic performance of the compressor by stationary computations.

6. The method according to claim 5, further comprising modifying the geometries of the blades of each of at least one of the rotor blading and the stator blading, and re-evaluating the aerodynamic performance of the compressor by stationary computations.

7. The method according to claim 6, wherein the aerodynamic coupling is updated after the re-evaluation of the performance of the compressor, by repeating the determining by instationary computations.

8. The method according to claim 6, wherein the aerodynamic coupling is updated by determining the geometric modifications applied to the blades of at least one of the rotor blading and the stator blading of an upstream stage n, by determining by computation an influence of the geometric modifications on the trajectories of the slipstreams of the trailing edges of the blades of the at least one of the rotor blading and the stator blading, by adapting accordingly the angular position of the at least one of the rotor blading and the stator blading of the downstream stage n+1, and by repeating the operations for all of at least one of the rotor bladings and the stator bladings, from upstream to downstream.

9. The method according to claim 1, wherein the instationary computations are Navier Stokes 3D computations.

* * * * *